US007556214B2

(12) United States Patent
Parrett et al.

(10) Patent No.: US 7,556,214 B2
(45) **Date of Patent: *Jul. 7, 2009**

(54) CUTTING ASSEMBLY

(75) Inventors: Dale H. Parrett, Springboro, OH (US); David Pitsch, Springfield, OH (US); Adam Downey, Springfield, OH (US)

(73) Assignee: Moyno, Inc., Springfield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/637,968

(22) Filed: Dec. 13, 2006

(65) Prior Publication Data

US 2007/0114312 A1 May 24, 2007

Related U.S. Application Data

(63) Continuation of application No. 11/032,900, filed on Jan. 11, 2005, now Pat. No. 7,178,749.

(51) Int. Cl.
*B02C 19/00* (2006.01)

(52) U.S. Cl. ..... 241/101.2; 241/224; 241/236; 241/295

(58) Field of Classification Search ..... 241/30, 241/101.2, 236, 222, 224, 295
See application file for complete search history.

(56) References Cited

U.S. PATENT DOCUMENTS

| | | | | | |
|---|---|---|---|---|---|
| 308,760 | A * | 12/1884 | Fairman | ..... | 241/235 |
| 1,459,713 | A | 6/1923 | Beggs | | |
| 2,512,764 | A | 6/1950 | Byram | | |
| 2,612,845 | A | 10/1952 | Byram et al. | | |
| 2,620,173 | A | 12/1952 | White | | |
| 2,785,455 | A | 3/1957 | McElroy | | |
| 3,248,092 | A | 4/1966 | Atkins | | |
| 3,730,487 | A | 5/1973 | Lund | | |
| 4,046,324 | A | 9/1977 | Chambers | | |
| 4,708,268 | A | 11/1987 | Wurtz | | |
| 5,048,764 | A * | 9/1991 | Flament | ..... | 241/36 |
| 5,526,991 | A * | 6/1996 | Bacher et al. | ..... | 241/65 |
| 5,722,820 | A | 3/1998 | Wild et al. | | |
| 6,010,086 | A | 1/2000 | Earle et al. | | |
| 6,120,267 | A | 9/2000 | Cunningham | | |
| 6,491,501 | B1 | 12/2002 | Wild et al. | | |
| 6,648,501 | B2 | 11/2003 | Huber et al. | | |
| 7,178,749 | B2 * | 2/2007 | Parrett et al. | ..... | 241/30 |
| 2003/0025019 | A1 * | 2/2003 | Coulter et al. | ..... | 241/236 |

FOREIGN PATENT DOCUMENTS

| | | |
|---|---|---|
| JP | 55-136597 | 10/1980 |

OTHER PUBLICATIONS

Brochure for "Moyno Annihilator" by Moyno, Inc. (2002).
Brochure for "Moyno 2000" by Moyno, Inc. (2003).

* cited by examiner

*Primary Examiner*—Mark Rosenbaum
(74) *Attorney, Agent, or Firm*—Thompson Hine LLP

(57) ABSTRACT

An apparatus including a pair of substantially parallel shafts. Each shaft has a plurality of axially spaced cutting blades mounted thereon such that each blade forms an oblique angle with respect to a central axis of the associated shaft. Each cutting blade includes a central body having a plurality of teeth radially spaced thereabout. The apparatus further includes a conveying device fluidly coupled to the shafts such that materials cut by the cutting blades are conveyable in a downstream direction by the conveying device.

13 Claims, 6 Drawing Sheets

CUTTING ASSEMBLY

This application is a continuation of U.S. application Ser. No. 11/032,900, filed on Jan. 11, 2005, now U.S. Pat. No. 7,178,749, the entire contents of which are hereby incorporated by reference.

BACKGROUND

The present invention is directed to a cutting apparatus, and more particularly, to a cutting apparatus with a plurality of teeth.

A typical progressing cavity pump (i.e., a helical gear pump), such as a model 2000 pump sold by Moyno, Inc of Springfield, Ohio, includes a rotor having one or more externally threaded helical lobes which cooperate with a stator having an internal bore extending axially therethrough. The bore includes a plurality of helical grooves (typically one more helical groove than the number of helical lobes of the rotor). Progressing cavity pumps are discussed in greater detail in U.S. Pat. Nos. 5,722,820, 6,120,267 and 6,491,501, the entire contents of which are incorporated herein by reference.

Pumps of this general type are typically built with a rigid metallic rotor and a stator that is formed from a flexible or resilient material such as rubber. The rotor is made to fit within the stator bore with an interference fit such that there is a compressive fit between the rotor and stator. This compressive fit results in seal lines where the rotor and stator contact. These seal lines define cavities bounded by the rotor and stator surfaces. As the rotor turns within the stator, the cavities defined by the seal lines progress from the suction end (i.e., inlet) of the pump to the discharge end (i.e., outlet) of the pump.

A typical progressing cavity pump may be used to pump a wide variety of fluids including solids, semi-solids, fluids with solids in suspension, highly viscus fluids and shear sensitive fluids. However, it is often difficult to introduce certain materials into the cavities between the stator and rotor during pumping operations.

Thus, the pump may be connected to a feeder that supplies materials to the pump inlet. The feeder may include a hopper and an auger. The hopper may include an inlet and an outlet such that material introduced in the inlet can be urged through the outlet of the hopper (i.e., to the inlet of the pump) via the auger. However, such feeders may be ineffective when large solid and semi-solid materials are introduced into the hopper. Other conveying devices, such as a screw feeder, belt press, centrifuge feed, conveyer, bridge breaker, or paddle pusher can also be used to move material downstream, or to the inlet of the pump.

Accordingly, there is a need for an apparatus for reducing the size of materials placed into a feeder.

SUMMARY

In one embodiment the invention is an apparatus including a pair of substantially parallel shafts. Each shaft has a plurality of axially spaced cutting blades mounted thereon such that each blade forms an oblique angle with respect to a central axis of the associated shaft. Each cutting blade includes a central body having a plurality of teeth radially spaced thereabout. The apparatus further includes a conveying device fluidly coupled to the shafts such that materials cut by the cutting blades are conveyable in a downstream direction by the conveying device.

In another embodiment the invention is a progressing cavity pump system including hopper having an inlet and an outlet and moving means coupled to the outlet. The system further includes a cutting apparatus positioned in the hopper, wherein the cutting apparatus includes a pair of substantially parallel shafts. Each shaft has a plurality of axially spaced cutting blades mounted thereon such that each blade forms an oblique angle with respect to a central axis of the associated shaft. Materials that are cut by the cutting apparatus are fed through the outlet and to the moving means.

In yet another embodiment the invention is a method for cutting materials including the step of providing a first shaft and a second substantially parallel shaft, each shaft having a plurality of axially spaced cutting blades mounted thereto to form an oblique angle with respect to a central axis of the associated shaft. The method further includes the steps of rotating each of the shafts about their respective central axes, feeding a material to be cut on or between the shafts, and automatically conveying the material, after the material is cut by the shafts, away from the shafts.

In yet another embodiment the invention is an apparatus including a pair of substantially parallel shafts. Each shaft has a plurality of axially spaced cutting blades mounted thereon such that each blade forms an oblique angle with respect to a central axis of the associated shaft. Each cutting blade includes a central body having a plurality of teeth radially spaced thereabout. Each tooth includes a base and a tip, wherein each tip has a greater circumferential length than the associated base.

DETAILED DESCRIPTION

Figure 1:
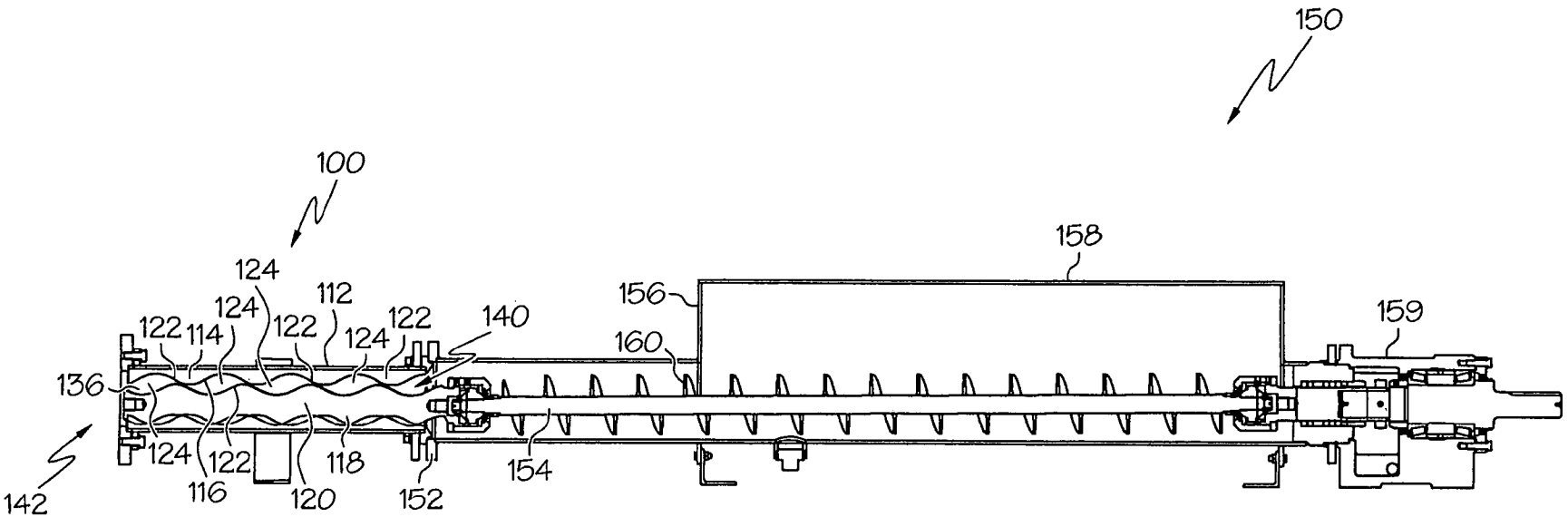
FIG. 1 is a front elevational view of a progressing cavity pump connected to a feeder apparatus.

The cutting assembly of the present invention may be coupled to or used in conjunction with a progressing cavity pump. As shown in FIG. 1, a progressing cavity pump 100 may include a generally cylindrical stator tube 112 having a stator 114 located therein. The stator 114 has an opening or internal bore 116 extending generally longitudinally therethrough in the form of a double lead helical nut to provide an internally threaded stator 114. The pump 100 includes an externally threaded rotor 118 in the form of a single lead helical screw rotationally received inside stator 114. The rotor 118 may include a single external helical lobe 120, with the pitch of the lobe 120 being twice the pitch of the internal helical grooves.

The rotor 118 fits within the stator bore 116 to provide a series of helical seal lines 122 where the rotor 118 and stator 114 contact each other or come in close proximity to each other. In particular, the external helical lobe 120 of the rotor 118 and the internal helical grooves of the stator 114 define the plurality of cavities 124 therebetween. The stator 114 has an inner surface 136 which the rotor 118 contacts or nearly contacts to create the cavities 124. The seal lines 122 define or seal off defined cavities 124 bounded by the rotor 118 and stator 114 surfaces.

The rotor 118 is rotationally coupled to an auger 154. Thus, when a motor (not shown) and bearing housing 159 assembly rotate the auger 154, the rotor 118 is rotated about its central axis and eccentrically rotates within the stator 114. As the rotor 118 turns within the stator 114, the cavities 124 progress from an inlet or suction end 140 of the rotor/stator pair to an outlet or discharge end 142 of the rotor/stator pair. During a single 360° revolution of the rotor 118, one set of cavities 124 is opened or created at the inlet end 140 at exactly the same rate that a second set of cavities 124 is closing or terminating at the outlet end 142 which results in a predictable, pulsationless flow of pumped fluid.

The pitch length of the stator 114 may be twice that of the rotor 118, and the present embodiment illustrates a rotor/stator assembly combination known as 1:2 profile elements, which means the rotor 118 has a single lead and the stator 114 has two leads. However, the present invention can also be used with any of a variety of rotor/stator configurations, including more complex progressing cavity pumps such as 9:10 designs where the rotor has nine leads and the stator has ten leads. In general, nearly any combination of leads may be used so long as the stator 114 has one more lead than the rotor 118. U.S. Pat. Nos. 2,512,764, 2,612,845, and 6,120,267, the entire contents of which are hereby incorporated by reference, provide additional information on the operation and construction of progressing cavity pumps.

A feeder apparatus 150 may be connected to the pump 100 by a connecting portion 152. The feeder 150 includes the rotating auger 154 positioned within a hopper 156 having an inlet 158 and an outlet 160. The outlet 160 of the hopper 156 is connected to the suction end 140 of the pump 100. Thus, during operation of the feeder 150, materials introduced into the inlet 158 of the hopper 156 are urged through the outlet 160 by the continuous rotation of the auger 154, and into the suction end 140 where the materials are pumped further downstream by the pump 100. The feeder apparatus can also take the form of a screw feeder, belt press, centrifuge feed, conveyer, bridge breaker, or paddle pusher. These components can also be used to move material to the inlet of the pump, or otherwise move the materials downstream.

As shown in FIGS. 4, 5A, 5B, 6A and 6B, the cutting apparatus of the present invention, generally designated 10, may be mounted in, near or adjacent to the inlet 158 of the hopper 156 by connecting portions 30. The cutting apparatus 10 may break up materials, particularly large materials, introduced into the hopper 156 prior to the materials contacting the auger 154 and entering the pump 100. By cutting and/or chopping materials to be pumped, the apparatus 10 of the present invention improves the efficiency of the pump 100, thereby allowing more materials to be pumped in a given amount of time at a reduced cost.

Figure 2:
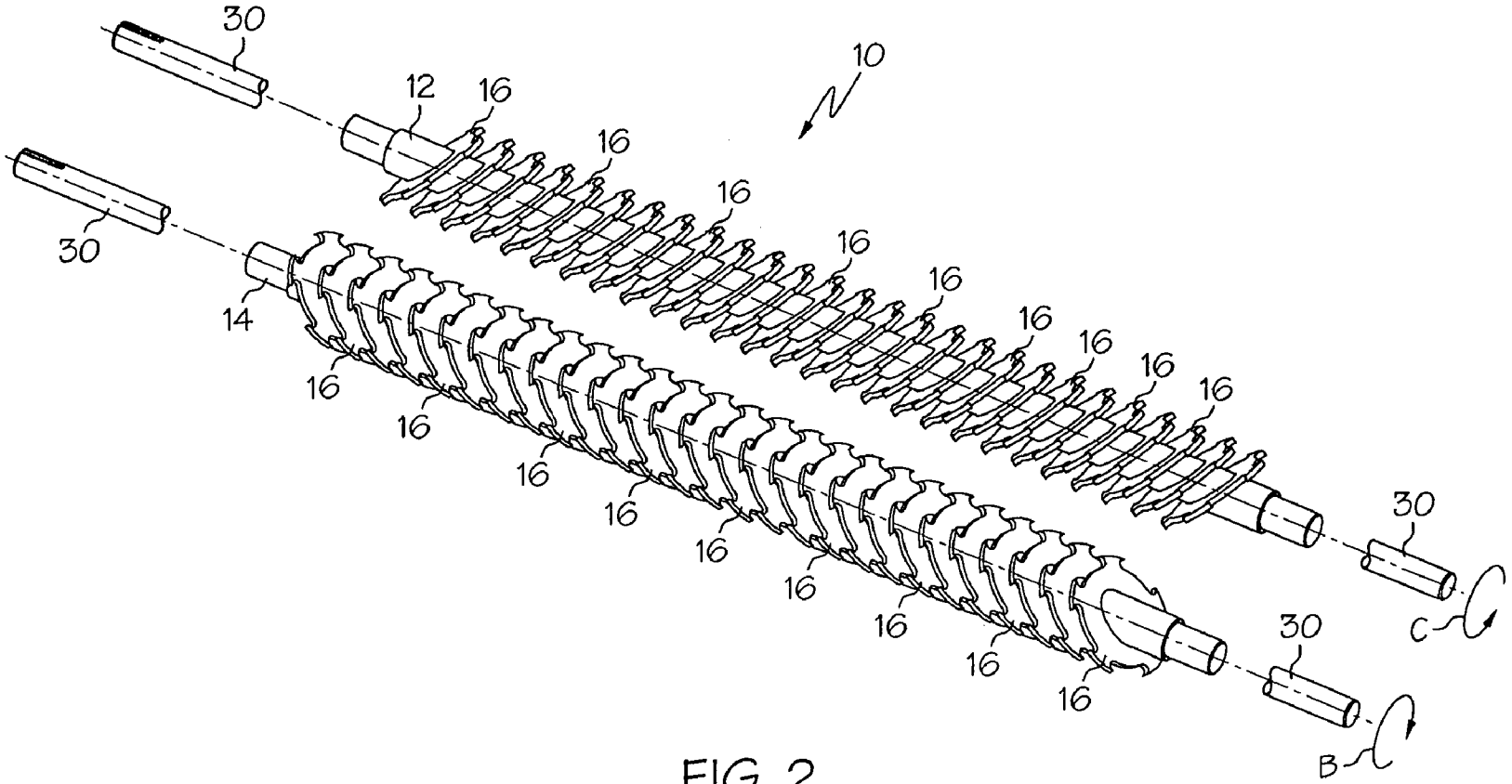
FIG. 2 is an exploded perspective view of a cutting apparatus of the present invention.

As best shown in FIG. 2, the cutting apparatus 10 includes a first shaft 12, a second shaft 14 and a plurality of cutting blades 16. A motor 36 (see FIGS. 4, 5A and 5B) is connected to the shafts 12, 14 to supply a rotational force to the shafts 12, 14 such that the shafts 12, 14 rotate about their central axes A (see FIG. 3B). Alternatively, each shaft 12, 14 may have its own respective motor (not shown) or the motor that drives the pump 100 and/or auger 154 may drive the shafts 12, 14. According to one embodiment, the first shaft 12 rotates in an opposite direction with respect to the second shaft 14, and more particularly, the shafts 12, 14 rotate such that the upper portions of the shafts rotate towards each other in the manner shown by arrows B and C of FIG. 2.

Figure 3B:
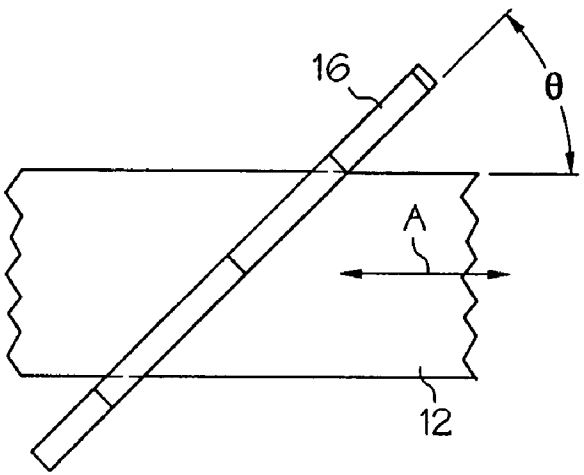
FIG. 3B is a side elevational view of the cutting blade of FIG. 3A mounted on a shaft.
Figure 3A:
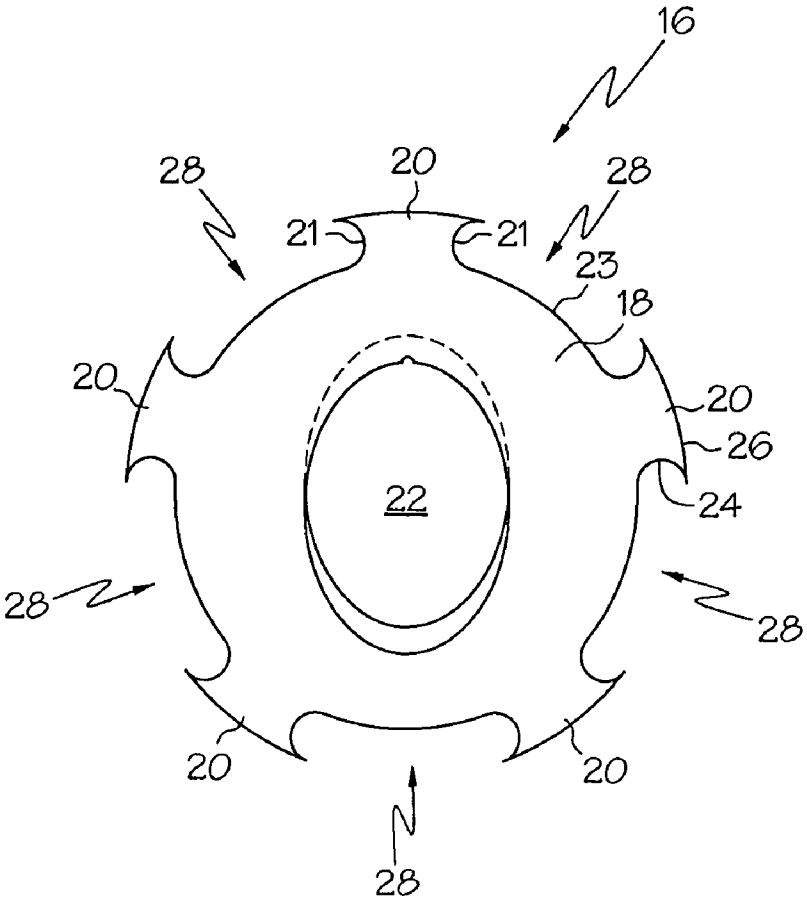
FIG. 3A is a front elevational view of a cutting blade of the apparatus of FIG. 2.
Figure 4:
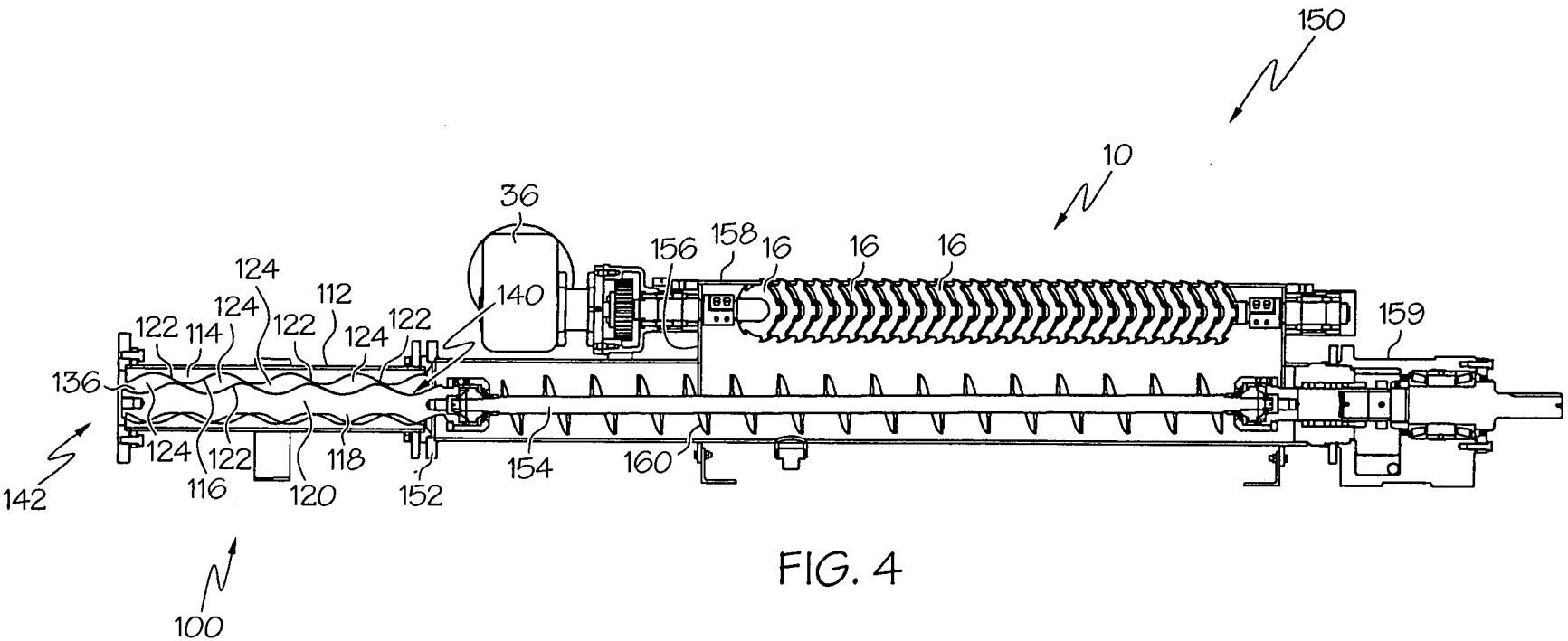
FIG. 4 is a front elevational view of a progressing cavity pump and feeder apparatus including the cutting apparatus of FIG. 2 positioned therein.
Figure 5A:
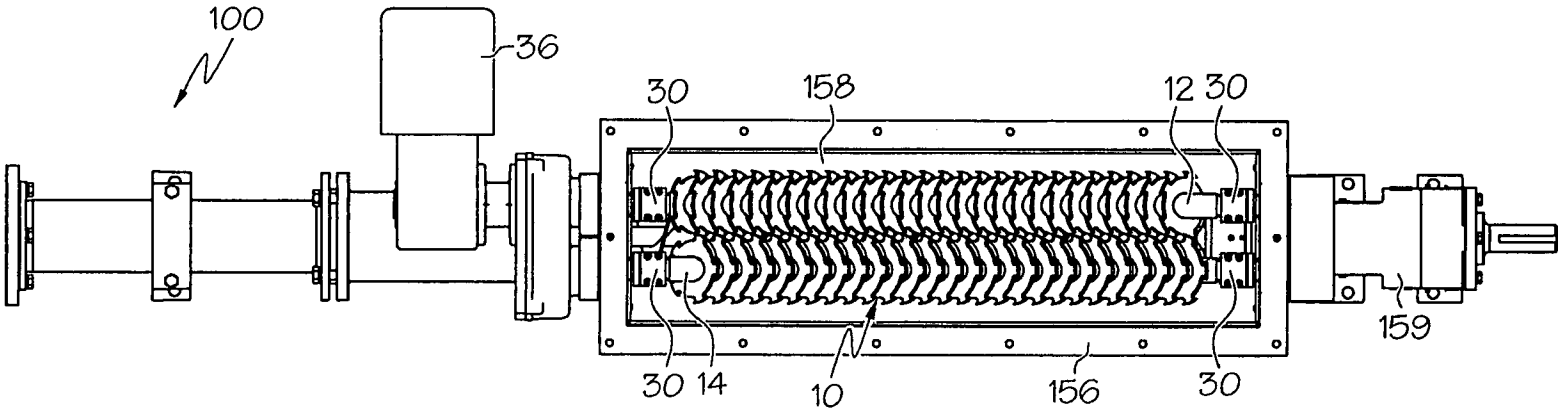
FIG. 5A is a top plan view of the feeder apparatus of FIG. 4 with the cutting apparatus in a first position.
Figure 5B:
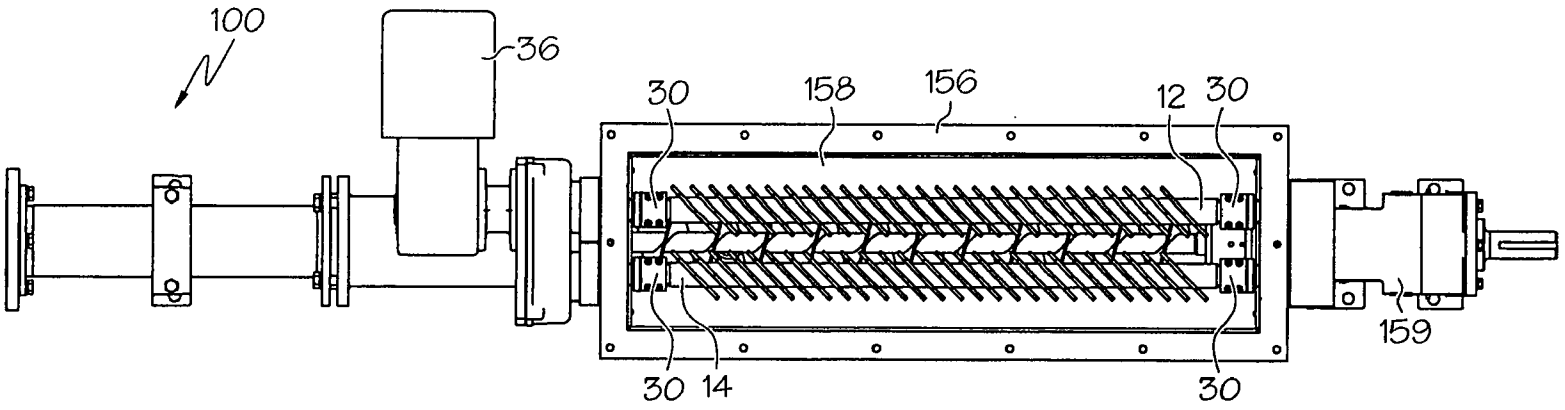
FIG. 5B is a top plan view of the feeder apparatus of FIG. 5A with the cutting apparatus in a second position.

As shown in FIG. 3A, each cutting blade 16 includes a central opening 22 and a central body portion 18 having an outer periphery 23. The central opening 22 receives one of the shafts 12, 14 therein, as shown in FIG. 3B, such that the cutting blade 16 may be secured to the associated shaft via screws, welds, adhesives, detents or the like. The central opening 22 and shafts 12, 14 may be circular in cross section. In an alternative embodiment, the central opening 22 and shafts 12, 14 may be non-circular (e.g., oval) in cross section, thereby preventing the blades 16 from rotating about the shafts 12, 14. As shown in FIGS. 3A and 3B, the cutting blade 16 may be generally disk-shaped and may have a generally circular outer periphery 23 in front view (see FIG. 3A). Alternatively, the central body 18 may be a variety of other shapes, including triangular, square, rectangular, polygonal or the like, and may not necessarily be flat or planar. The shafts 12, 14 may be located such that each shaft 12, 14 is located entirely inside the outer periphery 23 of the blade 16 (i.e., each blade 16 receives a shaft 12, 14 therethrough and the shaft 12, 14 is not directly coupled to the outer periphery 23).

Each cutting blade 16 includes a plurality of teeth 20 radially spaced about the periphery 23 of the central body 18 and extending generally radially outward from the central body 18. According to one embodiment, each blade includes five teeth 20, with each tooth 20 being circumferentially equally spaced apart from each other. Each tooth 20 may include a base portion 24 and a tip 26, wherein the tip 26 has a greater circumferential length than the associated base 24. The teeth 20 may be separated by radial gaps 28, wherein the circumferential length of each gap 28 is larger than the circumferential length of the tip portion 26 of each tooth 20. Each tooth 20 includes a curved cutting surface 21 on opposite sides thereof. Various numbers of teeth 20 radially extending from the central body 18 and having various sizes and geometries are within the scope of the present invention. In addition, each central body 18 may or may not include teeth 20 and may be configured in its basic shape to provide cutting surfaces (i.e., in the shape of triangles, stars and the like).

As shown in FIG. 3B, each cutting blade 16 is mounted to its respective shaft 12, 14 to form an oblique angle Θ with respect to the central axis A of the associated shaft 12, 14. The ability of the apparatus 10 to grip and tear material is increased by mounting the cutting blades 16 at an oblique angle Θ rather than perpendicular. According to one embodiment, the oblique angle Θ is 45 degrees. According to a second embodiment, the oblique angle Θ is in the range of between about 5 and about 85 degrees. Furthermore, when the shafts 12, 14 rotate in opposite directions, the blades 16 grip and force materials between the two shafts 12, 14 such that the angled blades 16 grip and tear the materials. The apparatus can accommodate various sizes of materials by adjusting the spacing between the two shafts 12, 14. For example, larger materials may be processed when the shafts 12, 14 are spaced further apart from each other.

The first shaft 12 may be aligned such that it is generally parallel with respect to the second shaft 14. The distance between the two shafts 12, 14 may be adjusted such that the cutting blades 16 on the first shaft 12 radially overlap with the cutting blades 16 on the second shaft 14. Alternatively, in order to accommodate larger materials (as discussed above), the shafts 12, 14 may be positioned such that there is no radial overlap between the cutting blades 16.

Figure 6B:
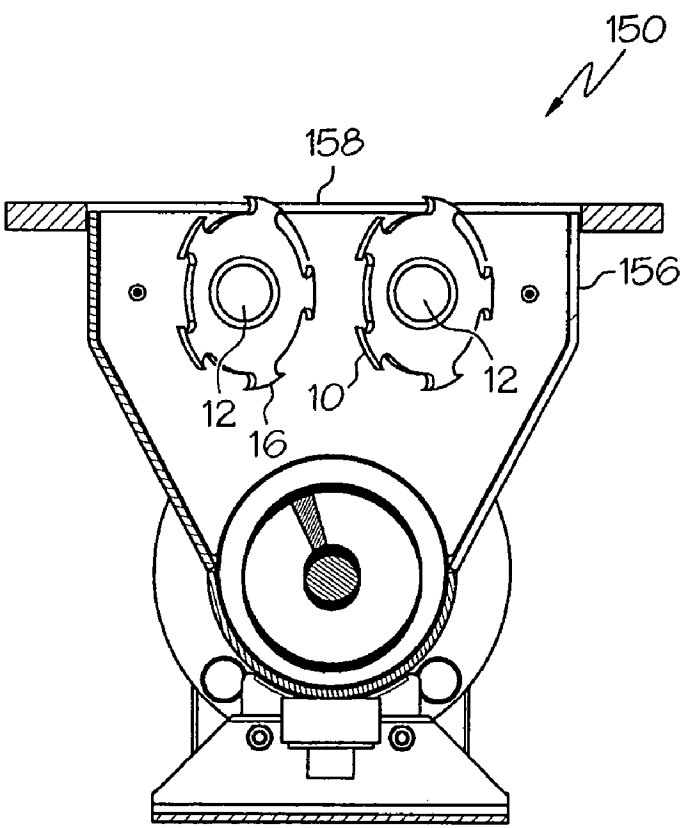
FIG. 6B is a side elevational view of the feeder apparatus of FIG. 5B.
Figure 6A:
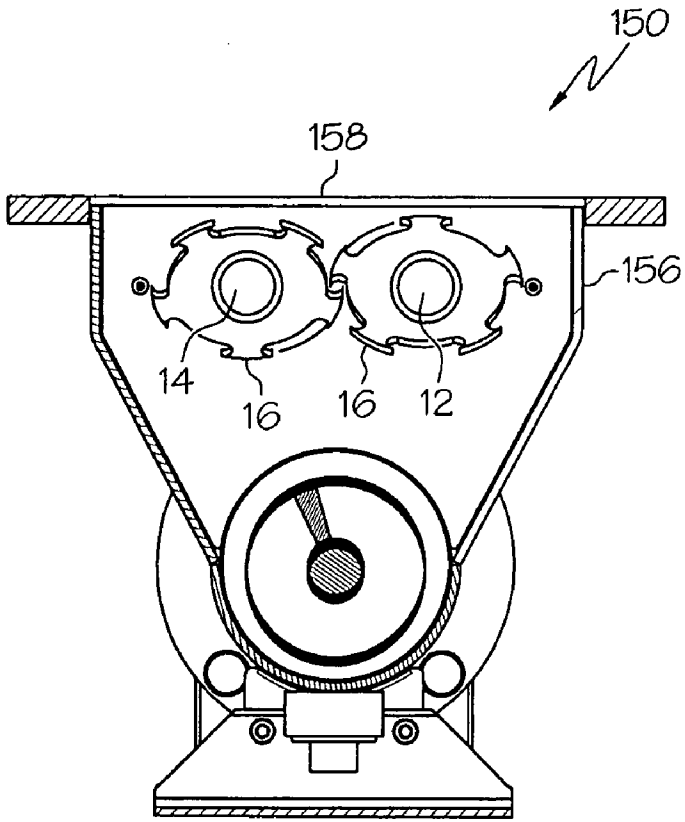
FIG. 6A is a side elevational view of the feeder apparatus of FIG. 5A.

According to one embodiment of the present invention, each shaft 12, 14 includes an equal number of cutting blades 16, wherein each cutting blade 16 is equally spaced on the respective shaft and mounted to form a 45 degree angle with respect to the central axis A of the associated shaft. The shafts 12, 14 may be mounted such that the blades 16 on one shaft 12, 14 are located at a midpoint between adjacent blades 16 on the other shaft 12, 14. The motor 36 is configured to rotate the first shaft 12 180 degrees out of phase with respect to the second shaft 14 (see FIG. 1) such that the shafts create an opening (see FIGS. 5B and 6B) and closing (see FIGS. 5A and 6A) action during rotation. The opening and closing action allows the cutting apparatus 10 to grip and tear materials, while forcing the materials towards the auger 154 and into the pump 100. As shown in FIG. 6A, when each cutting blade includes five equally spaced teeth 20 and the shafts are 180 degrees out of phase, one tooth 20 on shaft 14 is positioned at a "12-o'clock" position while one tooth 20 of shaft 12 is positioned at a "6-o'clock" position.

At this point it should be clear to one skilled in the art that the cutting performance (e.g., cutting speed and resulting particle size) can be controlled by adjusting (1) the spacing of the cutting blades 16 on the shafts 12, 14, (2) the angle Θ of the cutting blades 16, (3) the number, size and geometry of the blades 16 and teeth 20, and (4) the spacing between the two shafts 12, 14.

Accordingly, the present invention provides a method for cutting materials including the steps of providing a first shaft 12 and a second substantially parallel shaft 14, each shaft 12, 14 having a plurality of axially spaced cutting blades 16 mounted thereto to form an oblique angle Θ with respect to a central axis A of the associated shaft 12, 14, rotating each of the shafts 12, 14 about their respective central axis A, and feeding a material to be cut on the shafts 12, 14.

Although the invention is shown and described with respect to certain embodiments, it is obvious that equivalents and modifications will occur to those skilled in the art upon reading and understanding the specification. The present invention includes all such equivalents and modifications and is limited only by the scope of the claims.

What is claimed is:

1. An apparatus comprising:

a hopper having an inlet and an outlet;

a pair of substantially parallel shafts disposed in said inlet, each shaft having a plurality of axially spaced cutting blades mounted thereon such that each blade forms an oblique angle with respect to a central axis of the associated shaft, wherein each cutting blade includes a central body having a plurality of teeth radially spaced thereabout, each tooth of said plurality of teeth having a base and a tip, each tip having a greater circumferential length than the associated base;

an auger disposed between said inlet and said outlet; and a progressing cavity pump fluidly coupled to said outlet such that materials cut by said cutting blades are conveyable to said progressing cavity pump by said auger.

2. The apparatus of claim 1 further comprising a motor connected to said shafts for supplying a rotational force to said shafts.

3. The apparatus of claim 1 wherein said teeth extend generally radially from said central body.

4. The apparatus of claim 1 wherein said teeth are spaced from each other by a plurality of circumferential gaps.

5. The apparatus of claim 4 wherein said circumferential length is smaller than each circumferential gap.

6. The apparatus of claim 1 wherein said central body is generally disk-shaped.

7. The apparatus of claim 1 wherein said pair of shafts are configured to rotate in opposite directions.

8. The apparatus of claim 1 wherein said pair of shafts are configured to rotate substantially 180 degrees out of phase.

9. The apparatus of claim 1 wherein said pair of shafts are spaced such that at least one cutting blade on one of said shafts overlaps at least one cutting blade on the other one of said shafts in a radial direction.

10. The apparatus of claim 1 wherein said pair of shafts are spaced such that each cutting blade on one of said shafts overlaps with each cutting blade on the other one of said shafts in a radial direction.

11. The apparatus of claim 1 wherein said oblique angle is in the range of about 5 degrees to about 85 degrees.

12. The apparatus of claim 1 wherein said downstream direction is a direction away from said shafts.

13. The apparatus of claim 1 wherein each tooth of said plurality of teeth includes a first curved cutting surface positioned on a first side of said tooth and a second curved cutting surface positioned on a second, opposite side of said tooth.

* * * * *